United States Patent [19]

Beery et al.

[11] Patent Number: 4,483,890

[45] Date of Patent: Nov. 20, 1984

[54] DECORATING WITH SHRINK FILM

[75] Inventors: Floyd Beery, Prairie Village, Kans.; Ronald R. Renoe, Kansas City, Mo.; Larry Williams, Shawnee, Kans.

[73] Assignee: Hallmark Cards, Inc., Kansas City, Mo.

[21] Appl. No.: 460,143

[22] Filed: Jan. 24, 1983

[51] Int. Cl.[3] ..... A47G 33/08

[52] U.S. Cl. ..... 428/7; 428/11; 428/35; 428/36; 428/913

[58] Field of Search ..... 428/11, 357, 35, 36, 428/913, 7; 156/86

[56] References Cited

U.S. PATENT DOCUMENTS

| | | | |
|---|---|---|---|
| 1,581,823 | 4/1926 | Withycombe | 156/87 |
| 2,946,911 | 7/1960 | Malinowski et al. | 428/11 X |
| 3,462,632 | 8/1969 | Russi | 428/11 X |
| 3,586,897 | 6/1971 | Baird | 428/11 X |
| 3,791,899 | 2/1974 | Walters | 428/11 X |
| 3,806,397 | 4/1974 | Kukoff | 428/11 X |
| 3,829,348 | 8/1974 | Spiegel et al. | 428/11 |
| 3,841,956 | 10/1974 | Palazzolo et al. | 428/151 X |
| 3,950,604 | 4/1976 | Penneck | 428/913 X |
| 4,285,746 | 8/1981 | DePuy et al. | 428/11 X |
| 4,309,464 | 1/1982 | Rauch | 428/11 |

*Primary Examiner*—Henry F. Epstein

*Attorney, Agent, or Firm*—Neuman, Williams, Anderson & Olson

[57] ABSTRACT

Problems in producing decorative articles having a shrinkable plastic film secured thereto are eliminated by disposing between the article and the plastic film finely divided particulate matter. The particulate matter is of a particle size to form a texture on the article surface which permits escape of trapped air when the shrinkable plastic film is shrunk or to form trapped air cells which are so small and distributed so as to be substantially invisible to the naked eye. The particulate material can be dusted and evenly distributed on the article itself or dusted and distributed over the surface of the shrinkable film which contacts the article. Most preferably, the particulate material is applied in the form of a liquid coating.

6 Claims, No Drawings

DECORATING WITH SHRINK FILM

This invention relates to the art of decorating, and more particularly to the art of decorating wherein a decorative shrinkable film is applied to an article to provide a surface decoration thereon.

BACKGROUND OF THE INVENTION

Various articles are decorated by placing a decorative band of a shrinkable material around the article and then heating the band to cause it to shrink and to conform to the surface of the article. Spherical, cylindrical and irregularly shaped three-dimensional articles can be attractively ornamented in this manner. A few examples of such articles which can be conveniently decorated in this manner are fragile toys, glass articles, craft models and seasonal ornaments such as Christmas tree balls. This decorating technique possesses considerable advantages over prior techniques which involved decorating the articles by hand or by using silk screen or striping machinery. However, a serious problem is often encountered with use of such shrink-type decorative films, and particularly those which are transparent and only partially printed with a decoration. When a partially decorated transparent or a wholly translucent film is shrunk over a smooth or glossy surface, the result is often a blotchy appearance visible in the transparent areas and in translucent areas having a light ink coverage. The blotching results because of non-uniform shrinking of the shrinkable material resulting in visible non-attractive blotches of irregular size, shape and spacing. The blotching problem is magnified by the tacky, high-friction surface of the hot shrink material as it shrinks. Because of non-uniform heating and/or their inherent non-uniform shrink characteristics, heat-shrinkable films do not shrink at a uniform rate throughout the entire area thereof. This results in air being trapped under those film areas which shrink at a slower rate. Escape of the trapped air is prevented by the film areas which shrink at a faster rate and which become tightly secured to the surface of the articles. The difference in refractive index between these different areas underneath the film render them optically visible as blotches and detract from the appearance of the decorated object.

SUMMARY AND OBJECTS OF THE INVENTION

It is a major object of the invention to overcome the disadvantages or problems inherent in decorating articles by applying thereto a decorated, heat shrinkable film and securing the film to the article by heat shrinking.

It is another object of the invention to improve the appearance of decorated articles having heat-shrunk decorative films secured to smooth, glossy surface areas.

Another object of the invention is to provide improved methods of decorating articles by securing thereto a heat-shrunk decorative film.

It is another object of the invention to provide methods for eliminating a blotchy appearance on seasonal ornaments such as Christmas tree balls having a heat-shrunk decorative film secured to the outer surface.

Yet another object of the invention is to provide improved methods for decorating fragile articles by securing thereto a heat-shrunk decorative film.

A still further object of the invention is to provide improved methods for ornamenting articles having a smooth or glossy surface by securing thereto a heat-shrunk decorative film.

In accordance with the present invention prior problems in producing decorative articles having a shrinkable plastic film secured thereto are eliminated by disposing between the article and the plastic film finely divided particulate matter. The particulate matter is of a particle size to form a texture on the article surface which permits escape of trapped air when the shrinkable plastic film is shrunk or to form trapped air cells which are so small and distributed so as to be substantially invisible to the naked eye. The particulate material can be dusted and evenly distributed on the article itself or dusted and distributed over the surface of the shrinkable film which contacts the article.

In accordance with one most preferred embodiment of the present invention, prior to applying a decorative shrinkable film to an article to be decorated a coating which eliminates the appearance of blotches in the finished article is applied to the surface of the shrinkable film which contacts the articles. The coating is applied as a thin layer to uniformly cover substantially the entire inner surface of the shrink film which comes into contact with the article. The coating serves to eliminate the appearance of blotches when the shrink film is shrunk tightly around the object to be decorated, but the coating is formulated so as not to detract from the appearance and attractiveness of the article.

One embodiment of the invention involves methods for manufacturing a heat-shrinkable decorative article which can be readily applied to objects which are difficult to decorate. The heat-shrinkable decorative article comprises a band of desired size and shape of a heat-shrinkable thermoplastic having on the surface which contacts the object to be decorated an adherent coating which includes particulate solid matter.

Another embodiment of the invention involves a decorated article such as, for example, a Christmas tree ball which carries a surface decoration comprising a decorative heat-shrunk thermoplastic material with a layer of particulate solid material interspersed between the decorated article and the heat-shrunk decoration with the particle size of the particulate solid being such as to eliminate a blotchy appearance and yet be substantially invisible.

Another embodiment of the invention involves a decorated article such as, for example, a Christmas tree ball, which carries a surface decoration comprising a decorative heat shrunk thermoplastic material in which solid particulate material has been dispersed at the time the thermoplastic material was formed by extrusion, calendaring, etc.

According to a further embodiment of the invention, an article such as a fragile seasonal ornament is decorated by properly positioning around the ornament a decorated sleeve formed of a heat-shrinkable thermoplastic and having on its inner surface an adherent coating which contains particulate solid matter. The sleeve when properly positioned is subjected to heat to cause the sleeve to shrink and become tightly secured to the ornament. The sleeve carries a desired decorative design, pattern or color to provide the desired decoration for the ornament.

Another embodiment of the invention involves a method of manufacturing a heat-shrinkable article for use in decorating which comprises applying a liquid coating to a surface of a decorated heat-shrinkable plastic film and while still wet, applying solid particles to the wet surface and then drying the coating to cause the solid particles to be secured by the coating to the surface of said film in substantially the same distribution as the solid particles were applied originally.

DESCRIPTION OF PREFERRED EMBODIMENTS OF THE INVENTION

The particulate material can be applied to the object to be decorated or the inner surface of the plastic film in various ways, such as by simply dusting the surfaces. However, it is preferred to apply the particulate matter in the form of a liquid coating on the plastic film.

The coating applied to the inner surface of the decorative shrink film comprises a liquid carrier containing small insoluble solid particles which, when the coating is dried, are secured by the dried carrier and thus adherently distributed over substantially the entire surface area of the shrink film. The liquid carrier of the coating is selected from among a wide variety of liquids of a tacky or adhesive character which when dried adhere to the surface of heat-shrinkable materials such as polyvinyl chloride (PVC). Such liquids are well known and merely illustrative thereof may be mentioned nitrocellulose lacquers, acrylic lacquers, urethane varnishes, ultra violet curable coatings, pressure sensitive adhesive and the like. Since the heat-shrinkable decorative films are very frequently ornamented with a desired design or pattern utilizing conventional gravure printing methods, a preferred liquid carrier for the coating is any of the conventional overprint gravure lacquers. Such lacquers possess the desired tackiness or adherency properties with respect to shrink film materials. Moreover, such lacquers are readily available for the decorative gravure printing operation and can be applied using available coating apparatus such as are conventionally used in gravure printing operations. Therefore, the liquid carrier of the coating composition is preferably an overprint gravure lacquer or varnish. The liquid carrier can be substantially transparent or opaque or it can be tinted to match the article to be decorated. The liquid carrier selected should not dissolve any previously applied inks or cause the inks to bleed. Here again, conventional overprint gravure lacquers are generally satisfactory in these respects.

The solids component of the coating comprises particles of a solid organic or inorganic material insoluble in the liquid carrier, such as small glass beads, ground silica, ground feldspar, ground glass, wood flour, ground nut shells, ground corn cobs, ground starch and the like. The size of the solid particles is important in achieving desired results with respect to elimination of blotches on the finished decorated article. To be effective for the intended purpose, the particulate matter must have a particle size larger than the thickness of the adherent film attaching them to the shrinkable film. Similarly, the particles should not be so large as to be readily visible and to prevent the shrink film from tightly and smoothly conforming to the surface of the article to which it is applied. Moreover, the solid particles should preferably be of a size which permits application of the coating using available conventional coating application equipment. Generally, the solid particles of the coating can range in size from about 5 to 200 microns and preferably from 15 to 50 microns in the largest dimension thereof.

The amount of particulate matter to employ in the liquid carrier depends to large extent upon the density of the particles, their size and their wetability or oil absorption value. Generally, coating compositions containing from about 2 to 80% by weight, and more preferably from about 5 to 15% by weight, of particulate matter are employed.

The shrink films which are commonly used to provide ornamentation for fragile and difficult to decorate articles involve relatively thin sheets of films (usually 3 mils thickness or less) of natural and synthetic polymers which, when heated, shrink around an object in both high and low profile regions and conform to the object. Various heat-shrinkable plastics are known and commercially available, including shrink-type films formed from polyolefins such as polyethylene, polypropylene and copolymers thereof, "Saran Wrap", polystyrene, acrylics, polyvinyls such as polyvinyl chloride and the like.

DESCRIPTION OF SPECIFIC EMBODIMENTS OF THE INVENTION

To decorate an article in accordance with this invention, a band or sleeve of a heat-shrinkable film of desired size and shape having a desired pattern, design or color is formed. Various means of imprinting a desired design, color or pattern on the film can be utilized, such as conventional gravure printing techniques, lithography, silk screen, flexography and the like. A coating containing particulate matter in accordance with the preferred embodiment of this invention is applied to the inner surface of the band of the shrink-film. This can be accomplished by any convenient means such as by brush application, spraying or by use of conventional coating apparatus. The coating is preferably permitted to dry, and drying can be expedited by heating, if desired. If heating is employed to speed drying of the coating, care should be taken to avoid temperatures sufficiently high as to cause premature shrinkage of the heat-shrinkable film. The particulate coating can be applied to the inner surface of previously decorated ornamental shrink films or prior to decoration of the films. When the coating is dry the solid particles are secured thereby and substantially uniformly distributed as a layer over the inner surface of the shrink band.

The decorated band of shrinkable film having the particulate matter on its inner, object-contacting surface is then ready for application to the article to receive the decoration. This is accomplished by positioning in proper alignment the decorated, coated band of shrink-film around an article such as a tree ornament and subjecting the article and band to heat so as to cause the band to shrink to a tight fit around the ornament. Decoration of articles with predecorated shrink film materials is well known, and details as to this decorating technique need not be discussed. U.S. Pat. Nos. 3,829,348 and 4,285,746 relate to decorating articles such as Christmas tree balls utilizing pre-decorated bands or sleeves of shrinkable plastics.

As illustrative of the invention, a white glossy-surfaced porcelain Christmas tree ball is decorated by positioning around the mid-portion thereof a 3 to 4 inch wide sleeve of a transparent oriented polyvinyl chloride film (PVC) printed with a desired contrasting color. The length of the sleeve is such as to completely encircle the tree ball and the inner surface of the PVC sleeve is coated with a wax-free Croda overprint lacquer or varnish (Croda Ink Company No. 834–9450 Roto Aeroflex varnish) containing approximately 10% by weight of ground silica having an average particle size (greatest diameter) of about 15 microns. After the coating has dried leaving the silica particles distributed over and adhered to the PVC film, the PVC sleeve is placed around the mid-section of the ornamental tree ball and subjected to heating for approximately 5 seconds in a heat tunnel at a temperature of approximately 280° F. This causes the film to shrink tightly around the ball. In this way a Christmas tree ball having a glossy white exterior surface is ornamented with a decorative band encircling its mid-section with the band being aesthetically pleasing and without visible blotches or wrinkles.

The advantages of the invention are readily apparent from the foregoing. The invention eliminates serious problems heretofore encountered when decorating articles with decorative heat-shrinkable films. By means of the invention it is possible to decorate innumerable articles normally difficult to decorate, including smooth or glossy surfaced articles, without experiencing undesired blotching. The present invention can be carried out at low cost using readily available materials and equipment and is susceptible to automation. The invention has wide applicability with respect to decorating articles having a decorative shape which include free forms with some concave areas or more regular shapes with depressions, holes or slots to which a decorative band is applied.

Those modifications and equivalents which fall within the spirit of the invention are to be considered a part thereof.

What is claimed is:

1. A decorated article carrying on a surface thereof a film of a decorative heat-shrinkable plastic with a layer of particulate solid material interspersed between said article and said film, said particulate solid material being present in finely divided form sufficient to reduce blotching on the surface of the decorated article while permitting the film of heat-shrinkable plastic to tightly and smoothly conform to the surface of the decorated article.

2. A decorated article in accordance with claim 1 wherein the article which is decorated has a decorative shape.

3. A decorated article in accordance with claim 1 wherein the decorated article is generally spherical in shape or generally cylindrical in shape or irregular in shape.

4. A decorated article in accordance with claim 1 wherein the decorated article is a seasonal ornament.

5. A decorated article in accordance with claim 1 wherein the decorated article is an ornamental tree ball.

6. A decorated article in accordance with claim 1 wherein the particulate solid material has a particle size in the largest dimension thereof in the range of about 5 to 200 microns.

* * * * *